US006899334B1

(12) United States Patent
Lee

(10) Patent No.: US 6,899,334 B1
(45) Date of Patent: May 31, 2005

(54) SIDE BOARD FOR PLAYING TABLE

(75) Inventor: Min-Kuo Lee, Min Hsiung Hsiang (TW)

(73) Assignee: Hi-Star Co., Ltd., Min Hsiung Hsiang (TW)

( * ) Notice: Subject to any disclaimer, the term of this patent is extended or adjusted under 35 U.S.C. 154(b) by 0 days.

(21) Appl. No.: 10/862,746

(22) Filed: Jun. 7, 2004

(51) Int. Cl.[7] ..... A63F 9/00
(52) U.S. Cl. ..... 273/309; 273/108
(58) Field of Search ..... 273/309, 108

(56) References Cited

U.S. PATENT DOCUMENTS 3,711,099 A * 1/1973 Milu ..... 273/123 R
4,025,073 A * 5/1977 Furr et al. ..... 273/108.52
4,063,728 A * 12/1977 Zemanek ..... 473/13
4,705,275 A * 11/1987 Slater ..... 273/309
4,705,276 A * 11/1987 Kastle et al. ..... 273/309
4,949,977 A * 8/1990 Smith ..... 273/261
D340,821 S * 11/1993 Gibilterra ..... D6/480
5,630,760 A * 5/1997 Brown et al. ..... 273/108.52
5,841,878 A * 11/1998 Arnold et al. ..... 381/124
5,993,335 A * 11/1999 Eden et al. ..... 473/471
6,095,524 A * 8/2000 Richter et al. ..... 273/269
6,164,211 A * 12/2000 Faris ..... 108/11
6,349,939 B1 * 2/2002 Tsai ..... 273/108.1
6,402,642 B1 * 6/2002 Eden et al. ..... 473/471
6,712,711 B1 * 3/2004 Skelton et al. ..... 473/10
6,773,010 B2 * 8/2004 Zucchi et al. ..... 273/108.1
2004/0067796 A1 * 4/2004 Murray et al. ..... 473/4

* cited by examiner

*Primary Examiner*—Stephen Blad
*Assistant Examiner*—Dolores Collins
(74) *Attorney, Agent, or Firm*—Alan D. Kamrath; Nikolai & Mersereau, P.A.

(57) ABSTRACT

A playing table includes a main body, and four side boards mounted on a periphery of the main body. Each of the side boards includes a plurality of sheet plates combined with each other to previously form an outer appearance of each of the side boards, and an ornamental plate bonded on the sheet plates. Thus, each of the side boards is assembled rapidly, thereby facilitating a user mounting the side boards on the playing table.

11 Claims, 6 Drawing Sheets

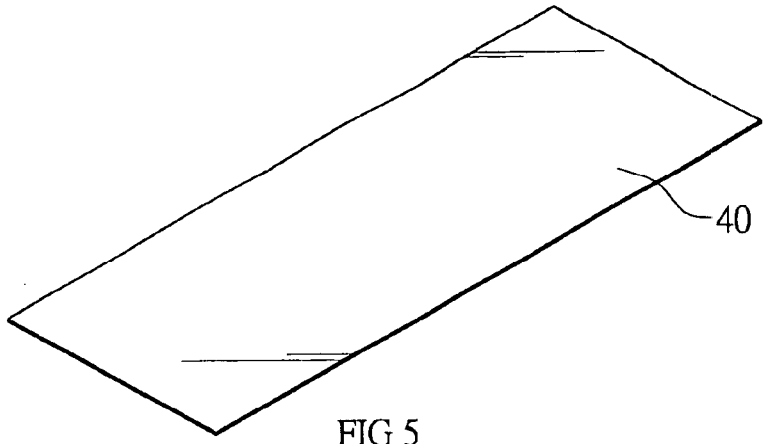
FIG 5
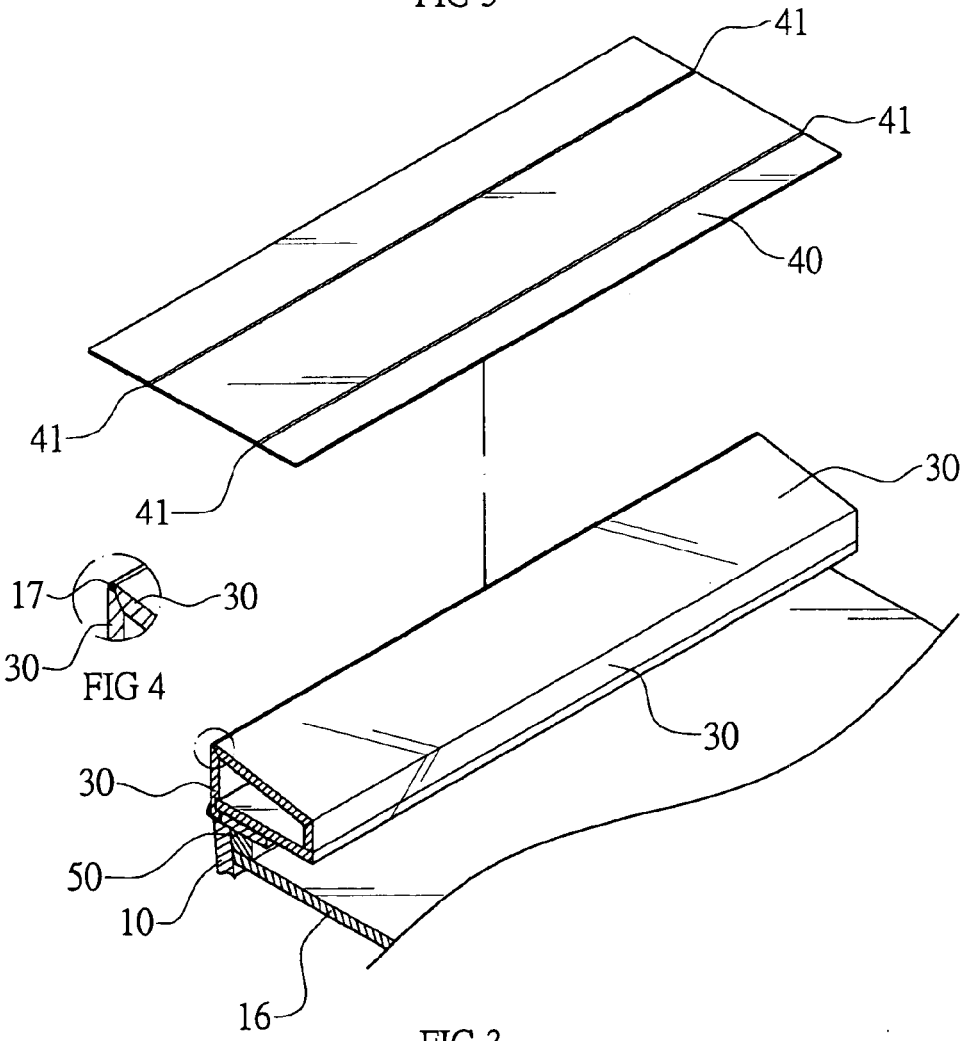
FIG 4
FIG 3

SIDE BOARD FOR PLAYING TABLE

BACKGROUND OF THE INVENTION

1. Field of the Invention

The present invention relates to a side board, and more particularly to a side board for a playing table, such as a football or hockey playing table.

2. Description of the Related Art

A conventional playing table in accordance with the prior art shown in FIG. 11 comprises a main body 60, a base plate 62 mounted on a top of the main body 60, four side boards 64 mounted on a periphery of the main body 60, and two feet (not shown) mounted on a bottom of the main body 60. Each of the side boards 64 includes an aluminum frame 66 formed by an aluminum extrusion process, and a packing 68 filled with the aluminum frame 13. However, each of the side boards 64 is heavy and bulky, thereby causing inconvenience in package, storage and transportation of the playing table.

Another conventional playing table in accordance with the prior art shown in FIG. 12 comprises a main body 70, a base plate 72 mounted on a top of the main body 70, four side boards 74 mounted on a periphery of the main body 70, and two feet (not shown) mounted on a bottom of the main body 70. Each of the side boards 74 includes solid wooden boards 75 combined with each other. However, each of the side boards 74 is heavy and bulky, thereby causing inconvenience in package, storage and transportation of the playing table.

SUMMARY OF THE INVENTION

In accordance with the present invention, there is provided a playing table, comprising a main body, and four side boards mounted on a periphery of the main body, wherein:

each of the side boards includes a plurality of sheet plates combined with each other to previously form an outer appearance of each of the side boards, and an ornamental plate bonded on the sheet plates.

The primary objective of the present invention is to provide a side board for a playing table, wherein each of the side boards is assembled easily and rapidly, thereby facilitating a user mounting the side boards on the playing table.

Another objective of the present invention is to provide a side board for a playing table, wherein each of the side boards has a light weight, thereby facilitating package, storage and transportation of the playing table.

A further objective of the present invention is to provide a side board for a playing table, wherein each of the side boards is made of cheaper material, thereby decreasing costs of the playing table.

A further objective of the present invention is to provide a side board for a playing table, wherein the sheet plate of each of the side boards has smaller thickness, so that the sheet plate is bendable to form different profiles and the ornamental plate is bendable to mate with the profiles of the sheet plates, thereby enhancing the aesthetic quality of the side boards of the playing table.

Further benefits and advantages of the present invention will become apparent after a careful reading of the detailed description with appropriate reference to the accompanying drawings.

BRIEF DESCRIPTION OF THE DRAWINGS

FIG. 3 is a partially exploded perspective view of the side board as shown in FIG. 2;

FIG. 4 is a partially enlarged view of the side board as shown in FIG. 3;

FIG. 5 is a partially enlarged view of the side board as shown in FIG. 3;

DETAILED DESCRIPTION OF THE INVENTION

Figure 1:
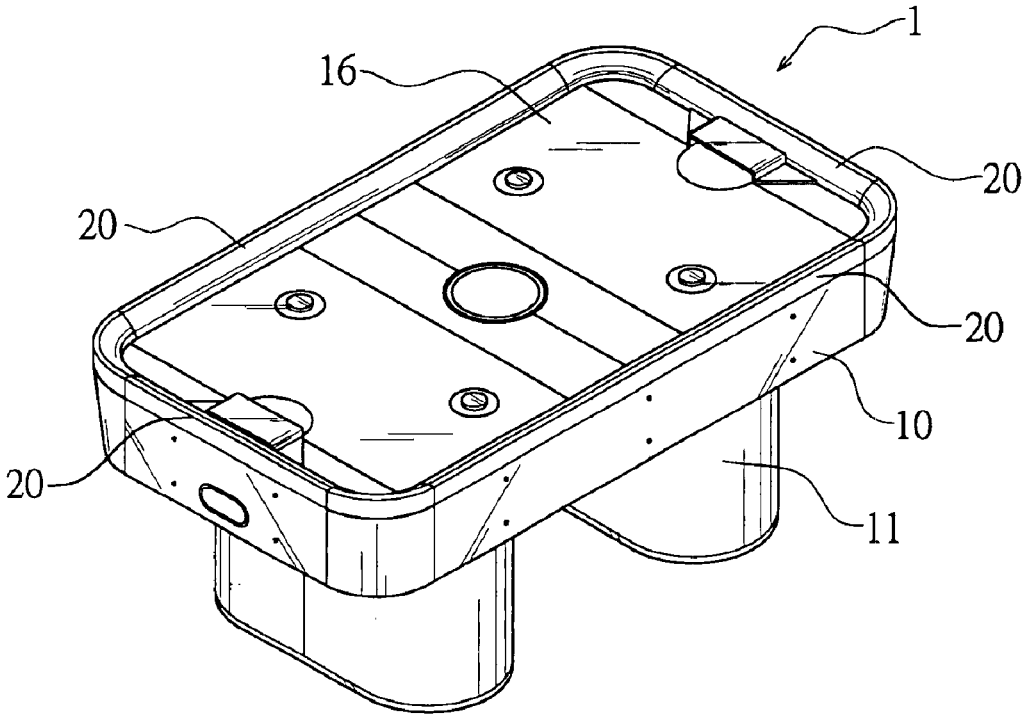
FIG. 1 is a perspective view of a playing table in accordance with the preferred embodiment of the present invention.

Referring to the drawings and initially to FIGS. 1–6, a playing table 1, such as a football or hockey playing table, in accordance with the preferred embodiment of the present invention comprises a main body 10, a base plate 16 mounted on a top of the main body 10, four side boards 20 mounted on a periphery of the main body 10, and two feet 11 mounted on a bottom of the main body 10.

Each of the side boards 20 includes a plurality of sheet plates 30 combined with each other to previously form an outer appearance of each of the side boards 20, and an ornamental plate 40 bonded on the sheet plates 30. Preferably, the connection of any two adjacent sheet plates 30 is provided with a rubber strip 17 (see FIG. 4).

The ornamental plate 40 has a surface formed with a plurality of elongated notches 41 (see FIG. 3), so that the ornamental plate 40 is bendable to encompass the sheet plates 30. Preferably, the ornamental plate 40 is made of aluminum, PVC, cloth or synthetic feather.

Accordingly, each of the side boards 20 is assembled easily and rapidly, thereby facilitating a user mounting the side boards 20 on the playing table 1. In addition, each of the side boards 20 has a light weight, thereby facilitating package, storage and transportation of the playing table 1. Further, each of the side boards 20 is made of cheaper material, thereby decreasing costs of the playing table 1. Further, the sheet plate 30 of each of the side boards 20 has smaller thickness, so that the sheet plate 30 is bendable to form different arc-shaped profiles and the ornamental plate 40 is bendable to mate with the profiles of the sheet plates 30, thereby enhancing the aesthetic quality of the side boards 20 of the playing table 1.

Figure 2:
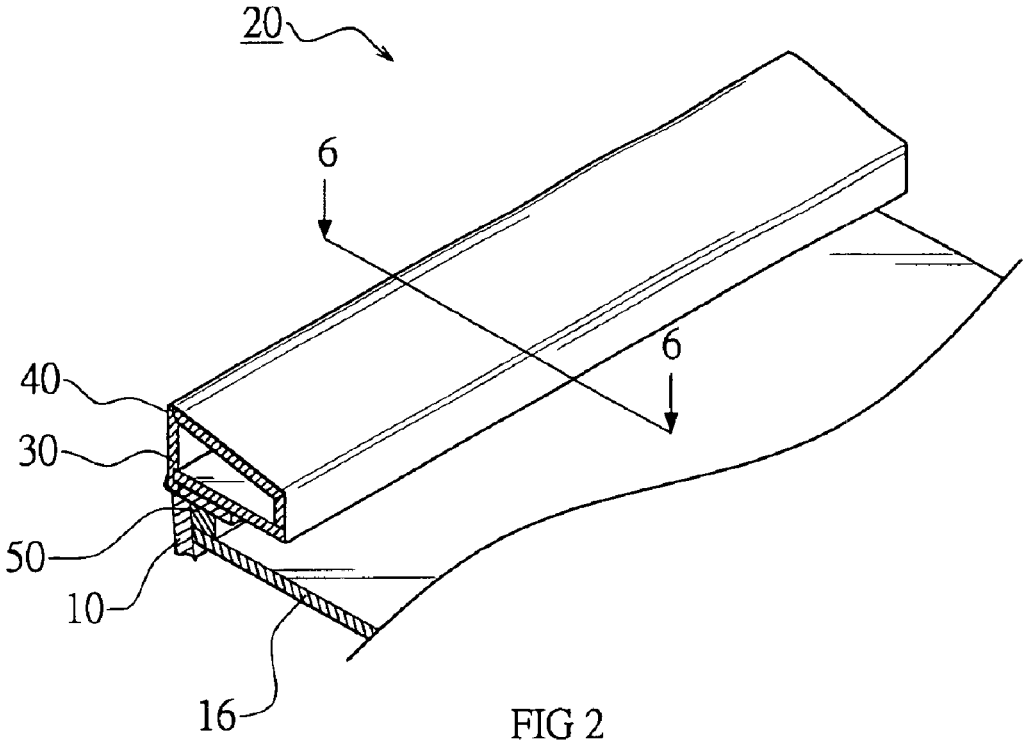
FIG. 2 is a partially cut-away perspective cross-sectional view of a side board for the playing table in accordance with the preferred embodiment of the present invention.
Figure 6:
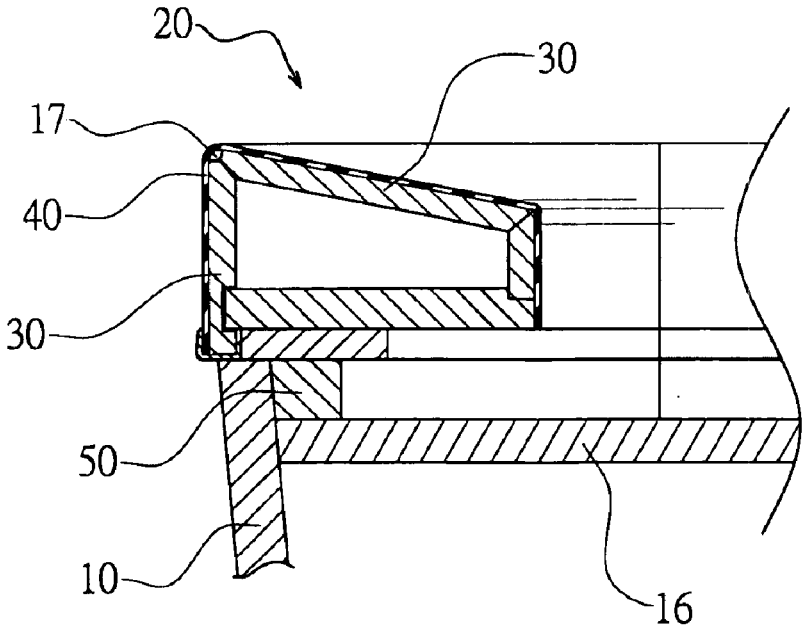
FIG. 6 is a side plan cross-sectional view of the side board taken along line 6—6 as shown in FIG. 2.

As shown in FIGS. 2 and 6, the playing table 1 further comprises a reinforcement board 50 mounted on a side of each of the side boards 20 so as to enhance the strength of the side boards 20.

Figure 7:
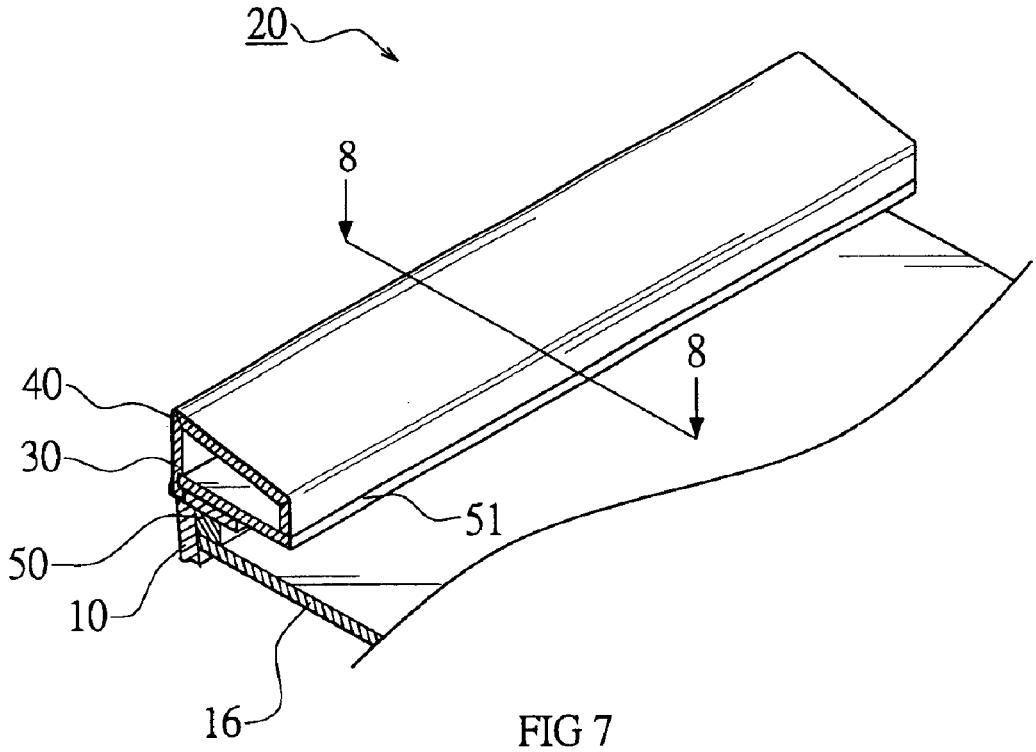
FIG. 7 is a partially cut-away perspective cross-sectional view of a side board for the playing table in accordance with another embodiment of the present invention.
Figure 8:
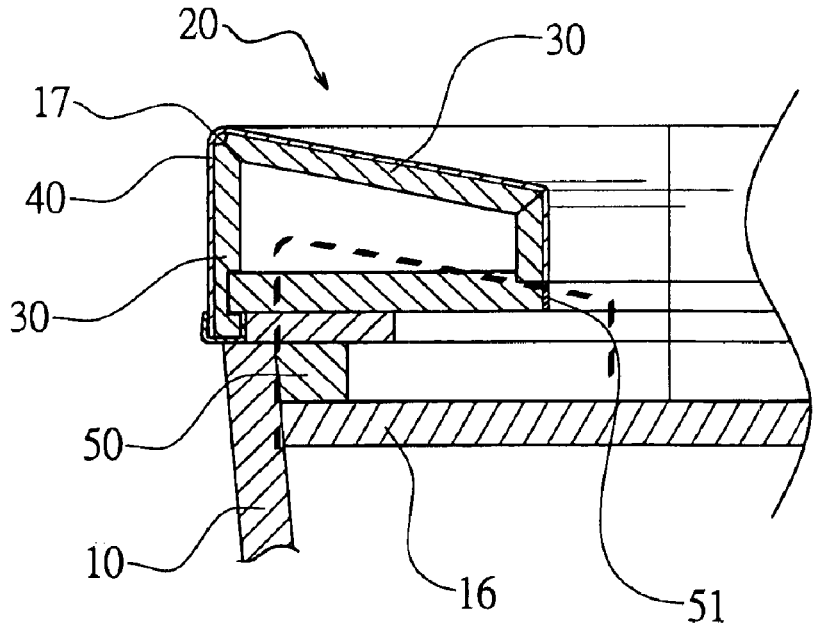
FIG. 8 is a side plan cross-sectional view of the side board taken along line 8—8 as shown in FIG. 7.

As shown in FIGS. 7 and 8, the playing table 1 further comprises a bumper board 51 mounted on an end of the ornamental plate 40 of each of the side boards 20 so as to protect the ornamental plate 40 of each of the side boards 20.

Figure 9:
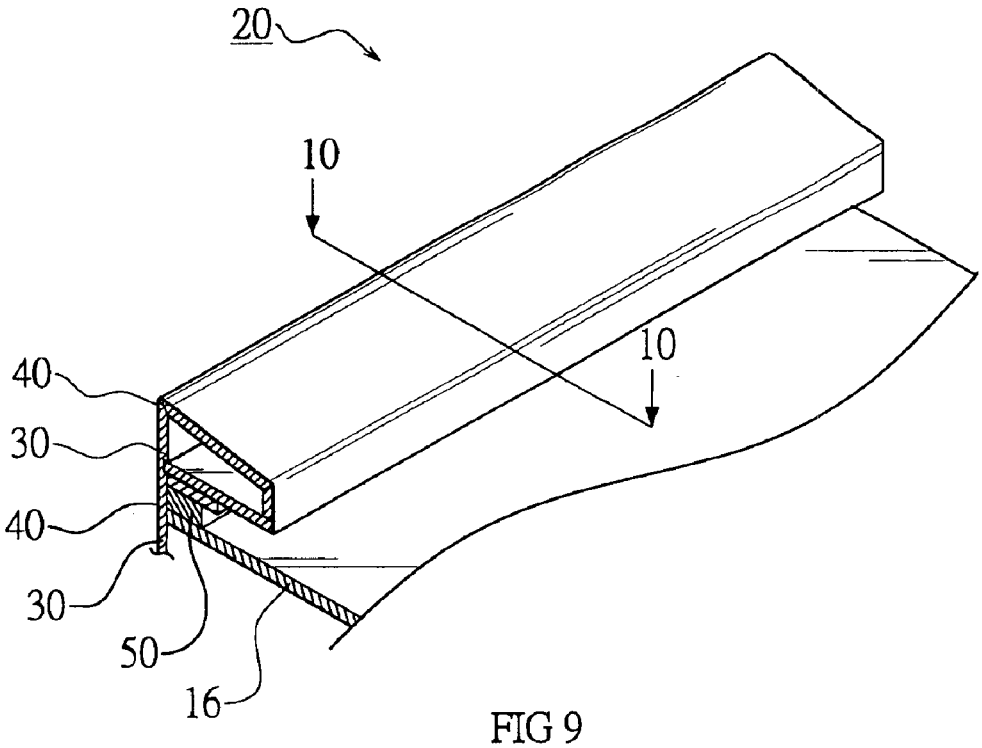
FIG. 9 is a partially cut-away perspective cross-sectional view of a side board for the playing table in accordance with another embodiment of the present invention.
Figure 10:
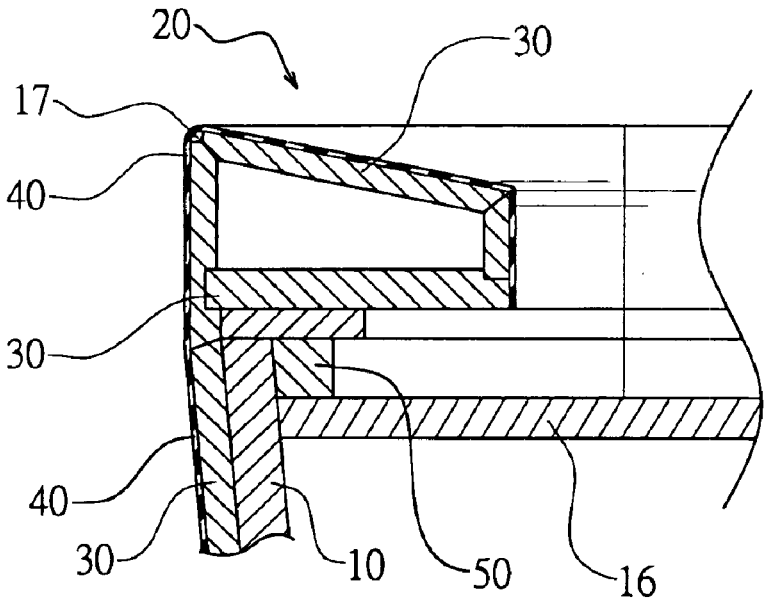
FIG. 10 is a side plan cross-sectional view of the side board taken along line 10—10 as shown in FIG. 9.
Figure 11:
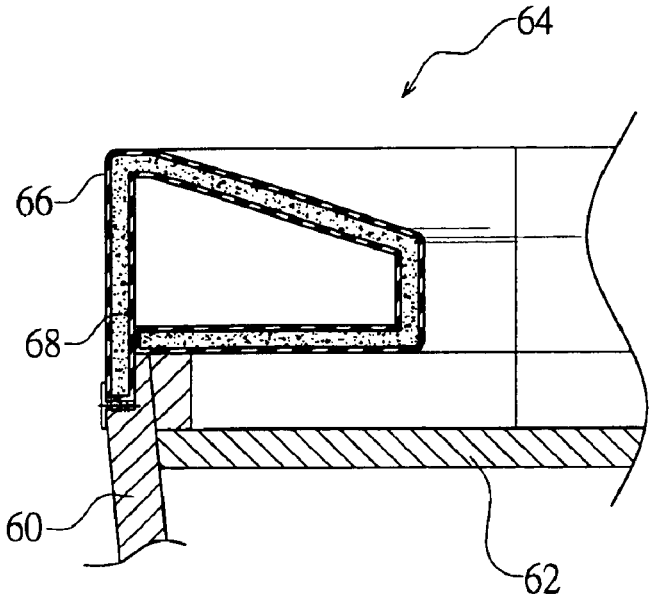
FIG 11 PRIOR ART
FIG. 11 is a partially plan cross-sectional view of a conventional side board for a playing table in accordance with the prior art.
Figure 12:
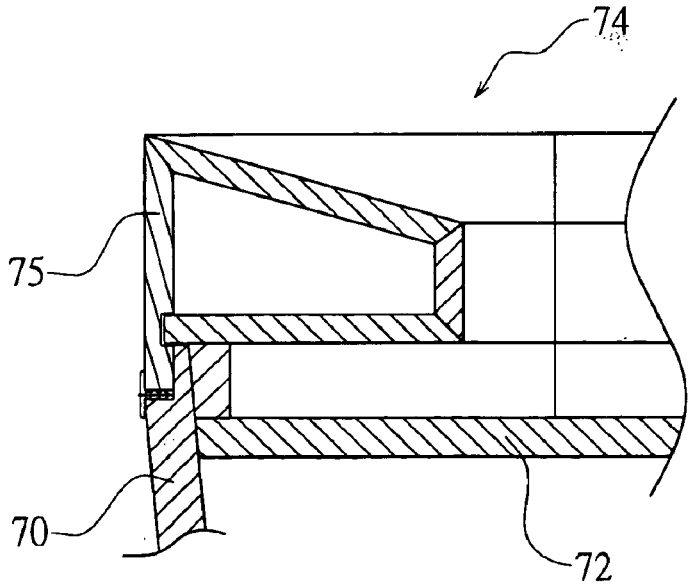
FIG 12 PRIOR ART
FIG. 12 is a partially plan cross-sectional view of another conventional side board for a playing table in accordance with the prior art.

As shown in FIGS. 9 and 10, the ornamental plate 40 and one of the sheet plate 30 of each of the side boards 20 are extended through a whole length of the periphery of the main body 10, so that the main body 10 is combined with the side boards 20 integrally.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A playing table, comprising a main body, and four side boards mounted on a periphery of the main body, wherein:

each of the side boards includes a plurality of sheet plates combined with each other, and an ornamental plate bonded on the sheet plates;

the ornamental plate has a surface formed with a plurality of elongated notches, so that the ornamental plate is bendable to encompass the sheet plates.

2. The playing table in accordance with claim 1, wherein a connection of any two adjacent sheet plates is provided with a rubber strip.

3. The playing table in accordance with claim 1, wherein the ornamental plate is made of aluminum.

4. The playing table in accordance with claim 1, wherein the ornamental plate is made of PVC.

5. The playing table in accordance with claim 1, wherein the ornamental plate is made of cloth.

6. The playing table in accordance with claim 1, wherein the ornamental plate is made of synthetic feather.

7. The playing table in accordance with claim 1, wherein the sheet plate of each of the side boards is bendable to form different profiles.

8. The playing table in accordance with claim 7, wherein the ornamental plate is bendable to mate with the profiles of the sheet plates.

9. The playing table in accordance with claim 1, further comprising a reinforcement board mounted on a side of each of the side boards.

10. The playing table in accordance with claim 1, wherein the ornamental plate and one of the sheet plates of each of the side boards are extended through a whole length of the periphery of the main body, so that the main body is combined with the side boards integrally.

11. A playing table, comprising:

a main body;

four side boards mounted on a periphery of the main body and each including a plurality of sheet plates combined with each other, and an ornamental plate bonded on the sheet plates; and a bumper board mounted on an end of the ornamental plate of each of the side boards.

* * * * *